United States Patent [19]

Bakker

[11] Patent Number: 4,502,305

[45] Date of Patent: Mar. 5, 1985

[54] SECURITY DEVICE

[75] Inventor: John A. Bakker, Bartlett, Ill.

[73] Assignee: Illinois Tool Works, Inc., Chicago, Ill.

[21] Appl. No.: 470,907

[22] Filed: Mar. 1, 1983

[51] Int. Cl.[3] ..... E05B 67/10

[52] U.S. Cl. ..... 70/49; 70/345; 70/346; 292/322; 292/320

[58] Field of Search ..... 70/49, 20, 31, 345, 70/346; 292/318–322, 307 R, 307 A, 307 B

[56] References Cited

U.S. PATENT DOCUMENTS

| | | | |
|---|---|---|---|
| 1,995,544 | 3/1935 | Larter | 70/20 |
| 2,125,052 | 7/1938 | Ranson | 70/49 X |
| 3,367,701 | 2/1968 | Wenk, Jr. | 292/321 |
| 3,712,655 | 1/1973 | Fuehrer | 292/322 X |

FOREIGN PATENT DOCUMENTS

| | | | |
|---|---|---|---|
| 1163273 | 4/1958 | France | 70/20 |
| 11907 | of 1909 | United Kingdom | 70/20 |

*Primary Examiner*—Gary L. Smith
*Assistant Examiner*—Thomas J. Dubnicka
*Attorney, Agent, or Firm*—J. P. O'Brien; T. W. Buckman

[57] ABSTRACT

A security latch is provided in the form of a two-piece molded plastic padlock. The padlock comprises a one-piece molded plastic body having an opening at one end thereof. The body is hollow and is closed at the open end by a plate. A flexible shackle is molded integrally with the lock body or a separate plate and has a free end with a resilient reentrant finger thereon. The free end is insertable into an opening with the finger snapping behind a structural portion of the lock to latch the free end within said opening. An additional access opening is provided into the body and a key element is insertable therein to cam said latching finger out of latching engagement to allow retraction of the shackle.

9 Claims, 19 Drawing Figures

FIG. 1
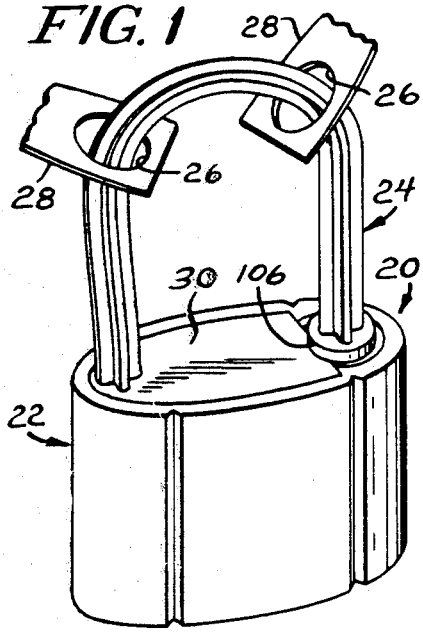
FIG. 2
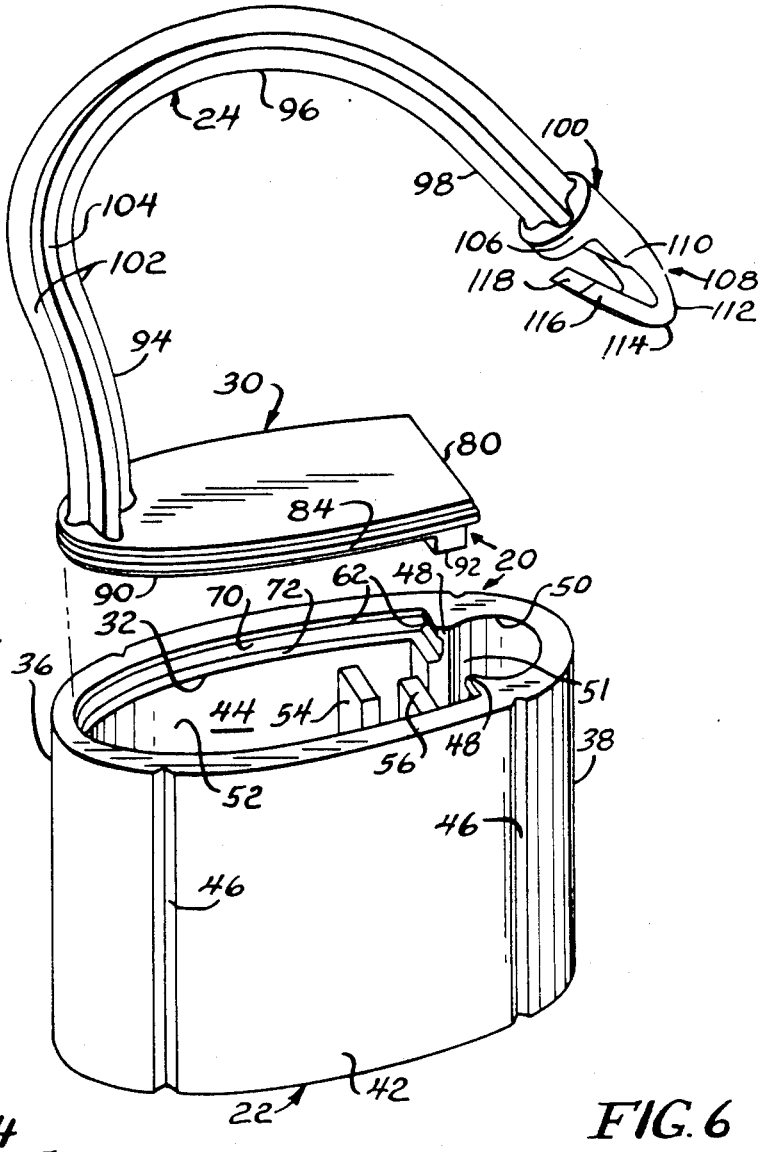
FIG. 2a
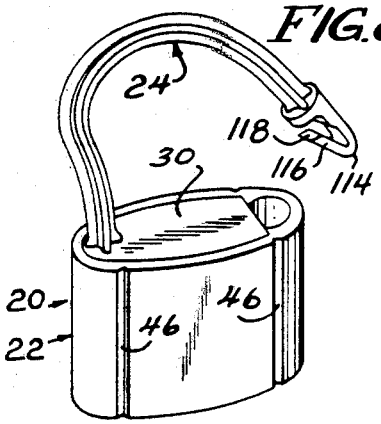
FIG. 3
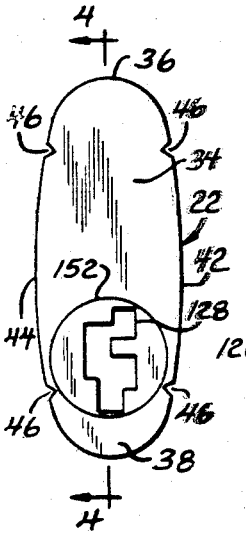
FIG. 4
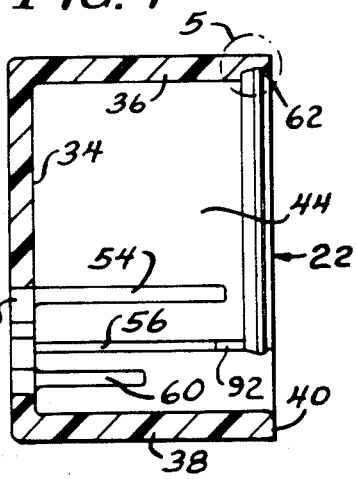
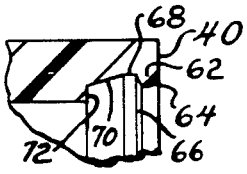
FIG. 5
FIG. 6
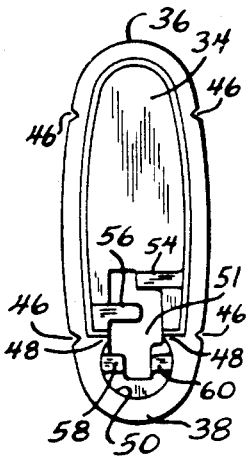

SECURITY DEVICE

BACKGROUND OF THE INVENTION

Soft-sided luggage in the nature of suitcases is commonly provided with a slide fastener or zipper closure extending along somewhat more than three sides of the luggage and having a pair of sliders thereon slideable from opposite ends to close the luggage with the two sliders in substantially a central position. It is known to provide a padlock or the like for securing together the two tabs or pulls on the sliders to discourage unauthorized opening of the luggage.

Small padlocks as heretofore used for this purpose have been made of metal and have been easily defeated, either by a simple tool or simply cutting the hasp of the padlock with wire or bolt cutters. The cost of such padlocks has been too high for the limited degree of security provided.

There are known inexpensive security devices made of metal or plastic in which a flexible member is placed through an eyelet or the like in a latch which is to be secured, and in which the flexible member is subsequently cut to open whatever it is that is secured. However, such security devices have a one-time use only and hence are so inconvenient for luggage security as to be totally disregarded in the marketplace.

OBJECTS AND SUMMARY OF THE PRESENT INVENTION

It is an object of the present invention to provide a security latch in the form of a plastic padlock openable with a key-like device.

More specifically, it is an object of the present invention to provide a reusable two piece plastic padlock openable with a key-like device.

Still further it is an object of the present invention to provide a plastic padlock of minimum cost.

In attaining the foregoing and other objects, a security latch for use with two zipper sliders on a soft-sided luggage piece is provided. The latch is in the form of a plastic padlock made of two pieces and openable with a key-like device. More particularly, the security latch is in the form of a padlock having a two piece plastic construction. A hollow body is molded, and a separate top or bottom piece is provided for closing the body. An integral, generally J-shaped shackle with a resilient re-entrant tip portion for locking under the top and within the body is formed a separate top piece is used when the upper end of the body is left open or is formed integrally with the body when the bottom is left open. A key-like device having a cam surface thereon is insertable through an aperture in the body to bear against the resilient portion to release the shackle.

THE DRAWINGS

The present invention will best be understood from the following description when taken in conjunction with the accompanying drawings wherein:

FIG. 1 is a perspective view of a security device constructed in accordance with the present invention and shown securing together two tabs or pulls of a slide fastener, commonly known as a zipper;

FIG. 2 is an exploded perspective view of the security device;

FIG. 2A is a view similar to FIG. 2 on a reduced scale showing the two parts of the lock in assembled relation;

FIG. 3 is a bottom view of the security device or lock;

FIG. 4 is a cross-section through the lock body taken along the line 4—4 in FIG. 3;

FIG. 5 is an enlarged detail taken from the circle 5 in FIG. 4;

FIG. 6 is a top view of the lock body;

DETAILED DISCLOSURE

Figure 9:
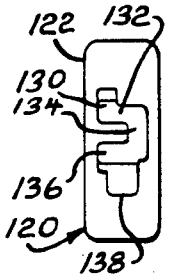
FIG. 9 is an end view of the key device of FIG. 7.
Figure 10:
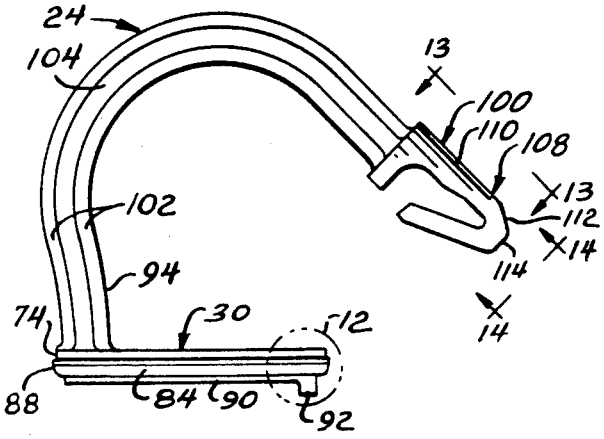
FIG. 10 is a side view of the top portion of the lock.

Referring first to FIGS. 1, 2 and 2A, there will be seen a security latch in the form of a padlock 20 having a body 22 and a shackle 24 with the shackle extending through the apertures 26 of the tabs or pulls 28 of two slide fastener slides on a slide fastener or zipper, such as on a piece of soft-sided luggage.

The shackle 24 is formed integrally with a top plate 30 received in the open upper end 32 of the lock body 22. It thus will be seen that there are only two parts to the lock 20, both molded of a suitable plastic, impact nylon being a preferred example.

The shape and construction of the one piece body will best be seen with reference to FIGS. 2 and 3–6. The body is of molded one piece construction and includes a flat bottom wall 34 (viewing the body as seen in FIG. 2) directly opposite the open upper end 32. The body is symmetric about a central vertical axis and is generally oval in cross-section, comprising a nearly semi-cylindrical left end 36 and right end 38 with walls extending upwardly from the bottom wall 34 to an upper peripheral margin 40. The end walls 36 and 38 are integrally interconnected by outwardly bowed or curved front and back walls 42 and 44 respectively. The front and back walls are each provided with two vertical grooves 46 adjacent the junctures with the end walls and providing surface ornamentation. The end walls and the front and back walls define the exterior appearance of the lock, but there are also internal walls or partitions that are important and which will be set forth immediately hereinafter.

Inwardly projecting walls 48 from the front and back walls 42 and 44 and adjacent thickenings from the end wall 38 define a cylindrical opening 50 communicating through a neck 51 with the open hollow space 52 of the body 22. The purpose for this will be seen hereinafter in connection with locking of the shackle in the body.

A vertical wall 54 extends forwardly from the rear wall 44 into the hollow space 52 to the mid-plane of the body and extends from the bottom wall 34 to a position of the top wall 30. The wall 54 is provided for cooperation with a key element as will be brought out hereinafter. The wall 54 lies somewhat between one-quarter and one-third of the way from the right end wall 38 to the left end wall 36.

Spaced slightly from the wall 54 toward the end wall 38 there is a wall 56 projecting from the front wall 42 and slightly beyond the previously mentioned mid-plane of the body. The walls 54 and 56 are parallel to one another and to the transverse mid-plane of the body. The wall 56 also cooperates with a key element as will be apparent hereinafter. The wall 56 is high as the wall 55 and extends toward the underside of the top wall 32.

Finally, there are two opposed stub walls 58 and 60 disposed diametrically within the circular opening 50. Each extends about one-third of the way across the opening and extends from the bottom wall about half way to the top wall. These stub walls cooperate with a key element as will be seen hereinafter.

The upper margin 40 of the body has previously been mentioned. As is seen in FIGS. 4 and 5, there is an inwardly directed peripheral flange 62 beveled at 64 where it merges with the upper margin 40 and having an underlying obtuse angle shoulder 66. The shoulder 66 forms the upper margin of a groove 68 tapering at 70 toward the interior hollow space 52 of the body and having an underlying right angle shoulder 72. The parts as just described are for forming a snap fit with the top wall 30, which is not to be described.

Attention should be directed to FIGS. 2, 2A and 10–14 for an understanding of the top plate 30 and the integral shackle 24. The left end of the top plate 30 is substantially circular as indicated at 74, while the side edges 78, respectively, are bowed outwardly so as to conform to the left end 36 and to the front and back walls 42 and 44 of the body 22. The right end, which is cut off at 80, is perpendicular to the principle center plane of the top plate 30 to interfit with the walls 48 adjacent the circular aperture 50.

Spaced below the top surface of the top wall 30 there is a peripheral flange 84 extending outwardly and having a chamfered or beveled outer lower edge 86 (FIGS. 10 and 12) with an upper obtuse angle shoulder 88. A lower section 90 is of the same shape as the top portion of the plate 30 but of reduced transverse dimension. A depending flange 92 is provided at the right edge.

The top plate is moved from the unassembled position of FIG. 2 to the assembled position of FIG. 2A. In so doing, the flange 84, aided and abetted by the chamfer 86 snaps past the flange 62, again aided by the bevel 64 so that the obtuse angle shoulder 88 of the top plate fits beneath the obtuse shoulder 66 of the body. A lower portion 90 bottoms against the shoulder 72 of the body, while the depending flange 92 engages the upper end of the wall 56.

The shackle 24 is formed integrally with the top cover 30 and extends initially substantially upwardly and slightly to the left as indicated at 94 to a nearly semi-circular portion 96, and finally to a straight section 98 forming an obtuse angle with the upright section 94. The general shape is of an opened U, or a J. A locking end portion 100 extends from the portion 98 in alignment therewith. The shackle 24 is generally cruciform in cross-section, having two relatively narrow flanges 102 lying parallel to and generally in the major access plane of the top plate 30 and of the body of the lock 22, and two wider flanges 104 at right angles to the flanges 102. The flanges provide a controlled rigidity-resiliency allowing the locking end 100 to be depressed as will be set forth shortly hereinafter, and resisting movement of the shackle from its initial plane, i.e., the major axis plane of the lock.

The locking end 100 comprises a cylindrical plug 106 integral with the remainder of the shackle, and a hook-like or re-entrant portion 108 comprising a flat tongue 110 extending from plug 106 away from the portion 98 of the shackle 24 to a beveled entering portion 112 reaching an apex 114 and then diagonally back upon itself at 116 to form a locking finger having a flat upper edge or extremity 118.

In use, once the shackle 24 has been passed through parts to be locked, such as the slide fastener tabs or pulls 28 in FIG. 1, the locking end 108 is pushed down into the cylindrical opening 50 in the lock body, the locking finger 116 camming past the end 80 of the top plate and snapping out beneath the plate. The locking finger thus resists retraction of the locking end of the shackle, whereby the security latch or lock remains in locked position as shown in FIG. 1.

A key element 120 (FIGS. 7–9) is provided for releasing the shackle from locked position. The key element 120 includes a generally flat, but surface contoured body 122 having an aperture 124 therein for securing to a keychain or the like. The key further includes a shank or releasing portion 126 having a cross-sectional shape adapted to interfit with the walls 54, 56, 58 and 60 and the inwardly projecting walls 48 and the similarly shaped opening 128 in the bottom wall 34 of the lock body. Such shape includes a vertical upper wall (considering the key as positioned horizontally) leading to an upper horizontal transverse wall 132. The latter is joined to a central offset vertical wall 134 leading to a lower transverse horizontal wall 136. A thickened centrally located depending flange 138 completes the cross-section of the shank 126.

Figure 7:
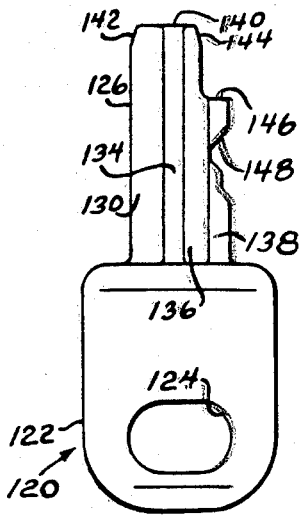
FIG. 7 is a side view of the key device for use with the present invention.
Figure 8:
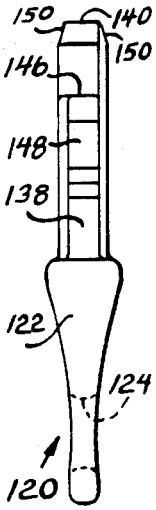
FIG. 8 is a top view of the key device of FIG. 7.
Figure 11:
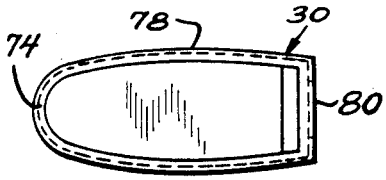
FIG. 11 is a bottom view thereof.
Figure 12:
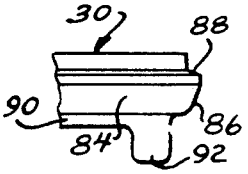
FIG. 12 is a detail view taken from the circle 12 in FIG. 10.
Figure 13:
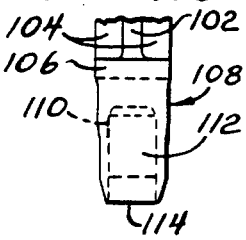
FIG. 13 is a fragmentary side view taken along the line 13—13 in FIG. 10.
Figure 14:
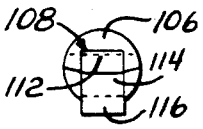
FIG. 14 is an end view of the shackle taken along the line 14—14 in FIG. 10.
Figure 15:
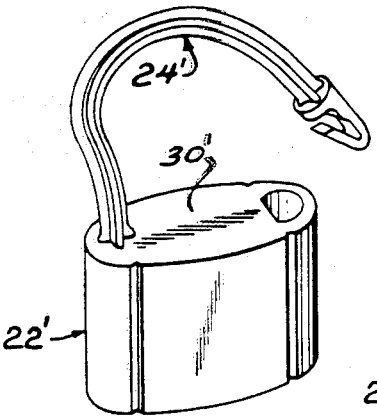
FIG. 15 is a perspective view of another embodiment of a security device constructed in accordance with the present invention.
Figure 16:
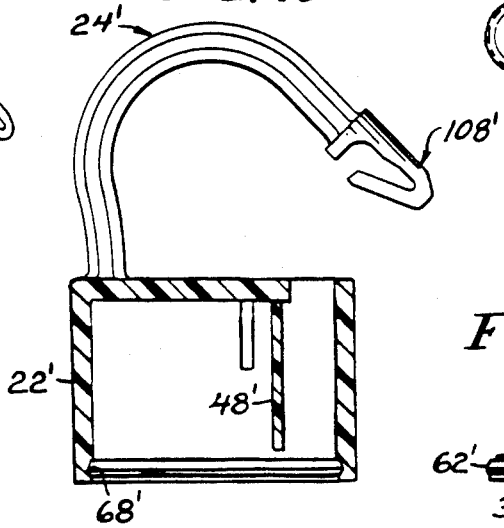
FIG. 16 is a side view of the embodiment shown in FIG. 15 with the body of the lock shown in cross-section.

The side view of the key element as shown in FIG. 7 reveals that the upper vertical wall 130 has a beveled chamfered surface 142 at the entering end 140 of the shank. A similar surface is provided on the lower entering end corner at 144. These beveled surfaces aid the key in entering the aperture 128 in the body, while the beveled surface 144 has an additional function as will be brought out shortly hereinafter. The lower flange provides a right angle shoulder 146 in the entering direction, while the remainder of the flange has a notched profile 148 to resemble a more conventional key. The sides of the key element shank 126 have tapered edges 150 (FIG. 8) at the entering end 140 further to aid in inserting the key element into the opening in the bottom of the lock body.

As will be appreciated with the locking or entering end of the shackle 24 in locking position, the apex 114 of the locking end bottoms against the upper ends of the walls 58 and 60 in the lock body while the upper flat surface 118 of the latching finger 116 fits beneath the end 80 of the top plate 30. The shank of the key element is inserted through the opening 128 into the internal space of the body among the walls as previously recited and is pushed in as far as it will go. This causes the beveled surface 144 to engage the locking finger 116 and to cam it toward the flat tongue 110, thus moving the top or upper flat surface 118 out from under the top plate end 80. The natural resilience of the shackle tends to retract it, and this is augmented by engagement of the shoulder 146 of the flange 138 with the apex 114. This generally does not cause complete removal of the entering end from the body, but it does release the entering end so that the shackle may be pulled on to complete the unlocking operation. It will readily be understood that the release is simply by camming action, and that there is no rotation of the key element.

However, an unauthorized person does not know this, since the plug 106 of the entering end completely seals the top portion of the cylindrical opening 50 so that any such unauthorized person cannot see into the interior of the lock to ascertain the construction thereof.

In FIG. 3 there will be seen a circular impression 152 surrounding the opening 128. This is left by a replaceable portion of the forming die which permits variation in size and placement of the internal walls, and also of the opening 128, for the use of different key elements with different locks. It is not contemplated that there should be a large number of minute variations since the present security latch or lock is only intended for rather minimal security, adequately guarding against accidental opening or opening by casual thieves.

It has been noted heretofore that the top plate 30 forms a snap fit within the upper portion of the lock body 22. It will be understood that it is within the contemplation of this invention to augment the snap fit or mechanical connection by known plastic welding methods such as sonic or solvent welding.

Referring now to the embodiment shown in FIGS. 15–18, wherein like structure is designated by the same number with the addition of a prime, it is seen that the top wall 30', and shackle 24', are integrally formed with the lock body 22'. Such an arrangement lends structural stability to the upper end of the lock body 22' when forces applied to the key for releasing the end 108' of the shackle would otherwise tend to disrupt the engagement of the top plate 30 of the other embodiment.

Figure 17:
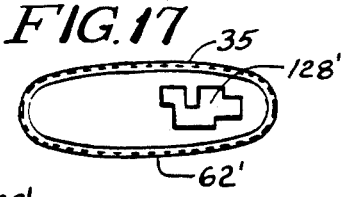
FIG. 17 is a plan view of the face of the bottom portion.
Figure 18:
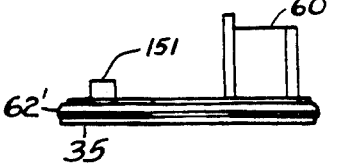
FIG. 18 is a side view of the bottom portion shown in FIG. 17.

Referring to FIGS. 17 and 18 the bottom plate 35 includes the same type of retaining flange 62' and groove 68' configuration as shown for retaining the top plate 30 to the body 22 of the other embodiment. The principle advantage of molding the lock in this manner is that the stability of the body, as pointed out above, is greater and that the access opening 128' is formed in the bottom plate 35 and may be changed to accommodate different keys. Thus, when the lock is assembled, a large number of bottom plates having different configurations of openings and accompanying keys may be used with a single standardized lock body in order to reduce the cost of manufacture and yet provide a security device that may require its own particular key.

It should be noted that the internal wall structure for various keys may also be easily changed due to the open bottom of the lock body, and as seen in FIG. 18, the wall 60' may be formed as part of bottom plate 35. Once the bottom plate has been assembled to the lock body, it is contemplated that the snap fit or mechanical connection of the type shown may be augmented by plastic welding, e.g., sonic or solvent welding. To preclude the bottom plate 35 from being assembled in a reversed position, an abutment 151 is positioned to engage a depending wall (not shown) from top plate 30' thereby preventing engagement of the flange 62' with the groove 68'.

The specific example of the invention as herein shown and described is for illustrative purposes only. Various changes in structure will no doubt occur to those skilled in the art and will be understood as forming a part of the present invention insofar as they fall within the spirit and scope of the appended claims.

I claim:

1. A security latch formed as a molded plastic padlock comprising a one-pice molded hollow plastic body having a latching area opening exteriorly and having external access means to said latching area for receipt of a releasing means, and a molded plastic shackle having an end insertable into said latching area, said shackle end having integral latch means thereon for retaining said shackle end in said latching area, said latch means being releasable by releasing means inserted into said access means, said hollow body open at one end, a member comprising a closure plate covering said open end, said closure plate and said hollow body have cooperating snap-over fastening means for retaining said plate on said body.

2. A security latch formed as a molded plastic padlock comprising a one-piece molded hollow plastic body having a latching area opening exteriorly and having external access means to said latching area for receipt of a releasing means, and a molded plastic shackle having an end insertable into said latching area, said shackle end having integral latch means thereon for retaining said shackle end in said latching area, said latch means being releasable by releasing means inserted into said access means, said hollow body open at one end, a member comprising a closure plate covering said open end, said closure plate and said shackle being integrally formed therewith thereby forming a single molded piece attachable to said body.

3. A security latch as set forth in claim 1 wherein said latch means comprises a resilient latching finger, and said releasing means engages and deflects said finger to release position.

4. A security latch as set forth in claim 3 wherein said resilient finger comprises a re-entrant finger.

5. A security latch as set forth in claim 3 wherein said latching finger is cammed to release position.

6. A security latch as set forth in claim 4 wherein said latching finger is cammed to release position.

7. A security latch as set forth in claim 3 wherein said body has interior walls to guide said releasing means.

8. A security latch as set forth in claim 1 wherein said shackle has a cruciform cross section to control flexibility thereof.

9. A security latch as set forth in claim 8 wherein said cross section has a greater lateral dimension to resist lateral deflection while permitting longitudinal bending.

* * * * *